US006926618B2

(12) United States Patent
Sanchez et al.

(10) Patent No.: US 6,926,618 B2
(45) Date of Patent: Aug. 9, 2005

(54) GOLF CLUB WITH DIAGONALLY REINFORCED CONTOURED FRONT WALL

(75) Inventors: Richard R. Sanchez, Glendale, AZ (US); Daniel J. Kubica, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/441,773

(22) Filed: May 19, 2003

(65) Prior Publication Data

US 2004/0235585 A1 Nov. 25, 2004

(51) Int. Cl.[7] ..... A63B 53/04

(52) U.S. Cl. ..... 473/329; 473/342; 473/345; 473/349

(58) Field of Search ..... 473/345–346, 473/324, 349, 350, 290, 329, 342; 472/291

(56) References Cited

U.S. PATENT DOCUMENTS

| | | | | | |
|---|---|---|---|---|---|
| 2,087,685 | A | * | 7/1937 | Hackney | 473/349 |
| 3,814,437 | A | * | 6/1974 | Winquist | 473/350 |
| 3,995,865 | A | * | 12/1976 | Cochran et al. | 473/337 |
| 4,511,145 | A | * | 4/1985 | Schmidt | 473/346 |
| 4,826,172 | A | * | 5/1989 | Antonious | 473/350 |
| 4,957,294 | A | * | 9/1990 | Long | 473/350 |
| 5,094,383 | A | * | 3/1992 | Anderson et al. | 228/176 |
| 5,547,427 | A | * | 8/1996 | Rigal et al. | 473/345 |
| 5,669,824 | A | * | 9/1997 | Aizawa et al. | 473/291 |
| 5,830,084 | A | | 11/1998 | Kosmatka | |
| 5,954,596 | A | * | 9/1999 | Noble et al. | 473/346 |
| 5,971,868 | A | * | 10/1999 | Kosmatka | 473/349 |
| 6,605,007 | B1 | * | 8/2003 | Bissonnette et al. | 473/329 |

FOREIGN PATENT DOCUMENTS

| | | |
|---|---|---|
| GB | 2331249 | 11/1998 |
| GB | 23844441 | 1/2003 |
| JP | 09064693 | 3/1997 |

* cited by examiner

*Primary Examiner*—Sebastiano Passaniti
(74) *Attorney, Agent, or Firm*—Darrell F. Marquette; John D. Titus

(57) ABSTRACT

A golf club head composed of a forged metal material has a striking surface that is supported by diagonal stiffening regions that extend from a central region of the face toward the heel-sole quadrant, heel-crown quadrant, toe-crown quadrant, and toe-sole quadrants of the face. The diagonal stiffening regions are smoothly contoured to blend into the back surface of the face so as to avoid any stress concentrations. By extending the stiffening regions diagonally from the center of the club face to the four quadrants, a more uniform stress distribution can be obtained and therefore more uniform performance. Additionally, since the diagonal stiffening regions are greater in length than vertical or horizontal stiffening region could be made, the center of the face can deflect a greater amount without exceeding the yield strength of the material and, therefore, there is a more efficient transfer of energy from the club head to the ball.

7 Claims, 4 Drawing Sheets

GOLF CLUB WITH DIAGONALLY REINFORCED CONTOURED FRONT WALL

BACKGROUND OF THE INVENTION

This invention relates generally to golf clubs and, in particular, to so-called metal wood golf clubs.

Golf clubs known as "woods" traditionally have a head made of a suitable wooden material such as maple or persimmon attached to one end of an elongated shaft. These traditional wood clubs are usually solid with a striking surface made of wood with or without a reinforcement (e.g., a polymer insert) at the intended impact point. Golf club "wood" heads have also been formed of suitable metals such as stainless steel, aluminum, and titanium. Metal wood heads are usually hollow so as to minimize weight while leaving the maximum amount of material available for the structural components of the heads. When the face of a golf club head strikes a golf ball, large impact forces are produced. In the relatively thin faces of hollow metal wood club heads, these large impact forces produce high shear and bending stresses, primarily in the area of the golf ball impact and around the perimeter of the face where it is joined to the sole, crown and sidewalls that make up the club head. In the extreme, these impact forces can exceed the low cycle fatigue limit of the material or even the ultimate tensile strength of the material, leading to face bending and cracking after an unacceptable short service life.

Various attempts have been made to reinforce the faces of hollow metal woods. Uniformly increasing the thickness of the club face requires the addition of a large amount of material much of which is very lightly stressed during use. The addition of such a large amount of material to a club face, however, adversely affects the performance of the club. The club performance is adversely affected because the club head center of mass is moved too far forward of the shaft axis and the club face is rendered too stiff for optimum energy transfer from the club to the golf ball.

Adding ribs to the back surface of the club face to stiffen the face has the benefit of stiffening without adding a significant amount of weight to the face. Ribs, however, have the detrimental result of causing stress concentrations and, if the ribs are asymmetrical, they may induce non-uniform bending over the surface of the face. Examples of such asymmetrically ribbed club faces include U.S. Pat. No. 5,474,296 to Schmidt, et al. which discloses a hollow metal driver having a front face with a large internal rib extending from the heel toward the middle of the face. U.S. Pat. No. 5,830,084 to Kosmatka discloses a hollow metal driver in which the internal reinforcements are smoothly contoured from the center of the club toward the crown and sole and toward the heel and toe. The ribs disclosed in Kosmatka yield a cruciform reinforcing structure that ties into the center of the crown and sole as well as the center of the side walls. Although the smoothly contoured cruciform reinforcing structure is an improvement over the prior art asymmetric reinforcements and sharply defined ribs, because of the aspect ratio of the golf club, the vertical rib will necessarily be shorter than the horizontal rib. This leads to higher stresses at the face-crown interface and crown-sole interface than at the face-heel and face-toe interfaces. Consequently, the face-crown interface and face-sole interface must be substantially reinforced with additional material that adds weight to the face. Moreover, the shorter, stiffer vertical rib causes the cruciform reinforced face to have asymmetric bending characteristics leading to unpredictable performance. Accordingly, what is needed is a contoured golf club face in which the smoothly contoured stiffening regions are substantially symmetrical and equal in length to provide a reinforced face having uniform properties.

SUMMARY OF THE INVENTION

The present invention comprises a golf club head composed of a forged metal material in which the striking surface has diagonal stiffening regions that extend from a central region of the face toward the heel-sole quadrant, heel-crown quadrant, toe-crown quadrant, and toe-sole quadrants of the face. The diagonal stiffening regions are smoothly contoured to blend into the back surface of the face so as to avoid any stress concentrations. By extending the stiffening regions diagonally from the center of the club face to the four quadrants, a more uniform stress distribution can be obtained and therefor more uniform performance. Additionally, since the club face is quasi-rectangular in shape, the diagonal stiffening regions are greater in length than a vertical or horizontal stiffening region could be made. Consequently, the center of the face can deflect a greater amount without exceeding the yield strength of the material and, therefore, there is a more efficient transfer of energy from the club head to the ball.

BRIEF DESCRIPTION OF THE DRAWING

The present invention will be better understood from a reading of the following detailed description, taken in conjunction with the accompanying drawing figures in which like references designate like elements, and in which.

DETAILED DESCRIPTION

Figure 1:
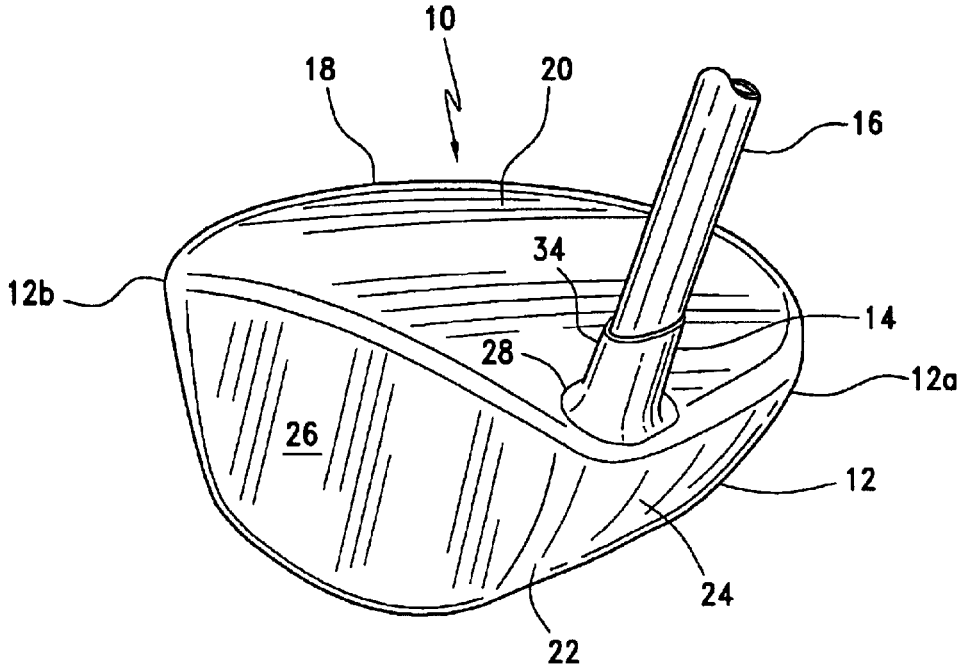
FIG. 1 is a perspective view of a golf club incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed, but are merely illustrative and intended to teach one of ordinary skill how to make, and/or use the invention claimed herein and for setting forth the best mode for carrying out the invention.

FIG. 1 depicts a golf club 10 comprising a head 12, a hosel 14 and a shaft 16. Head 12 is composed of a hollow body 18 made of a first material such as titanium having a high shear modulus of elasticity and a high strength to weight ratio. The hollow body 18 has a top wall (or crown) 20, a bottom wall (or sole) 22, and a side wall (or skirt) 24 that connects the top wall 20 to the bottom wall 22. Hollow body 18 has a face 26 preferably composed of a forged material configured to impact a golf ball during use. Head 12 further defines a heel end 12*a* and a toe end 12*b*. A hosel bore 28 is provided in the heel end 12*a* of head 12 to receive the hosel 14. Hosel bore 28 extends downwardly from the body top wall 20 toward the body bottom wall 22. Upper portion 34 of hosel 14 extends above top wall 20 of hollow body 18 and is adapted to receive a golf shaft 16 therein.

Figure 2:
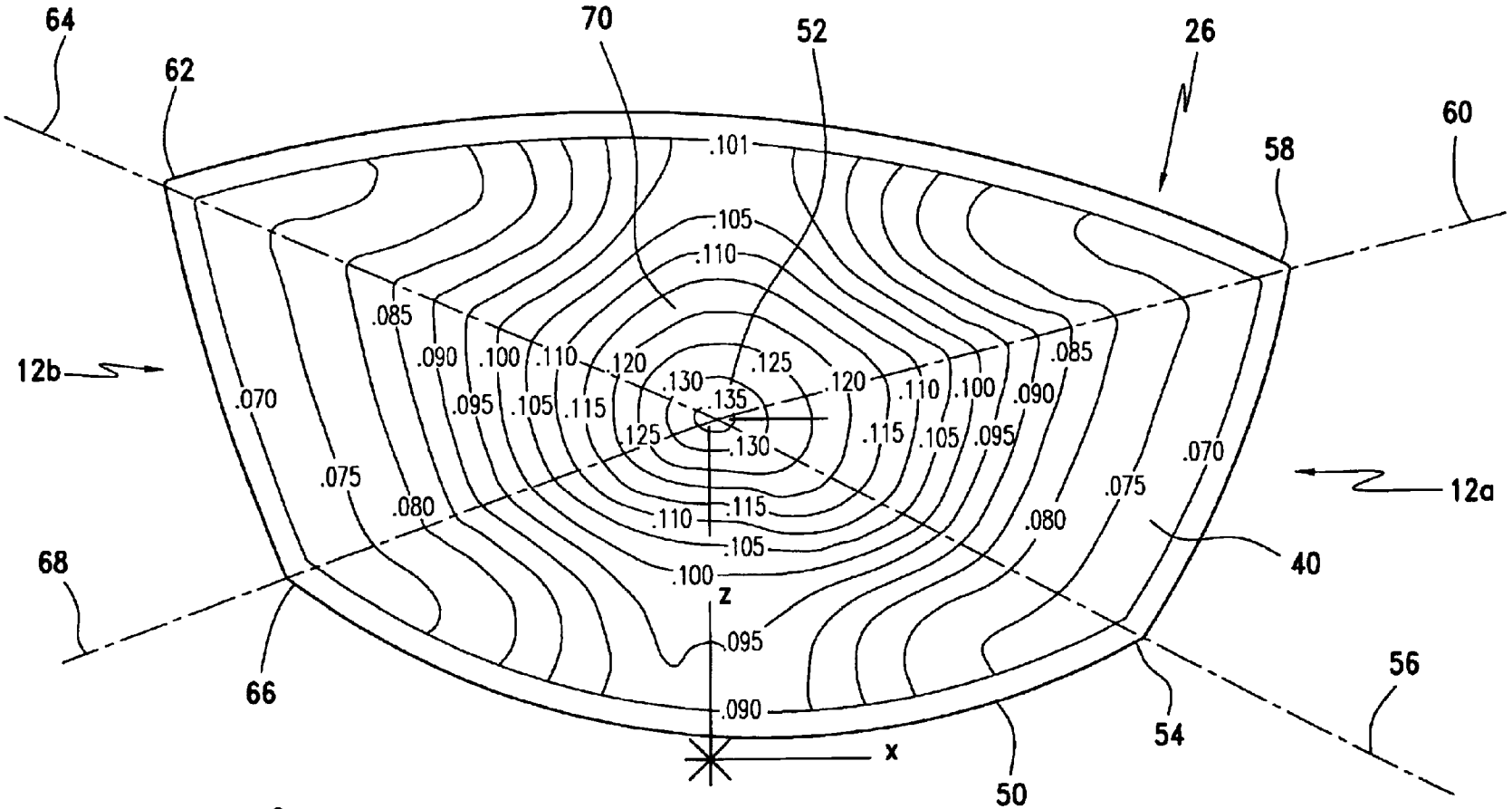
FIG. 2 is a plan view of the back surface of the face of the golf club of FIG. 1 with contour lines to show the stiffening regions.
Figure 3:
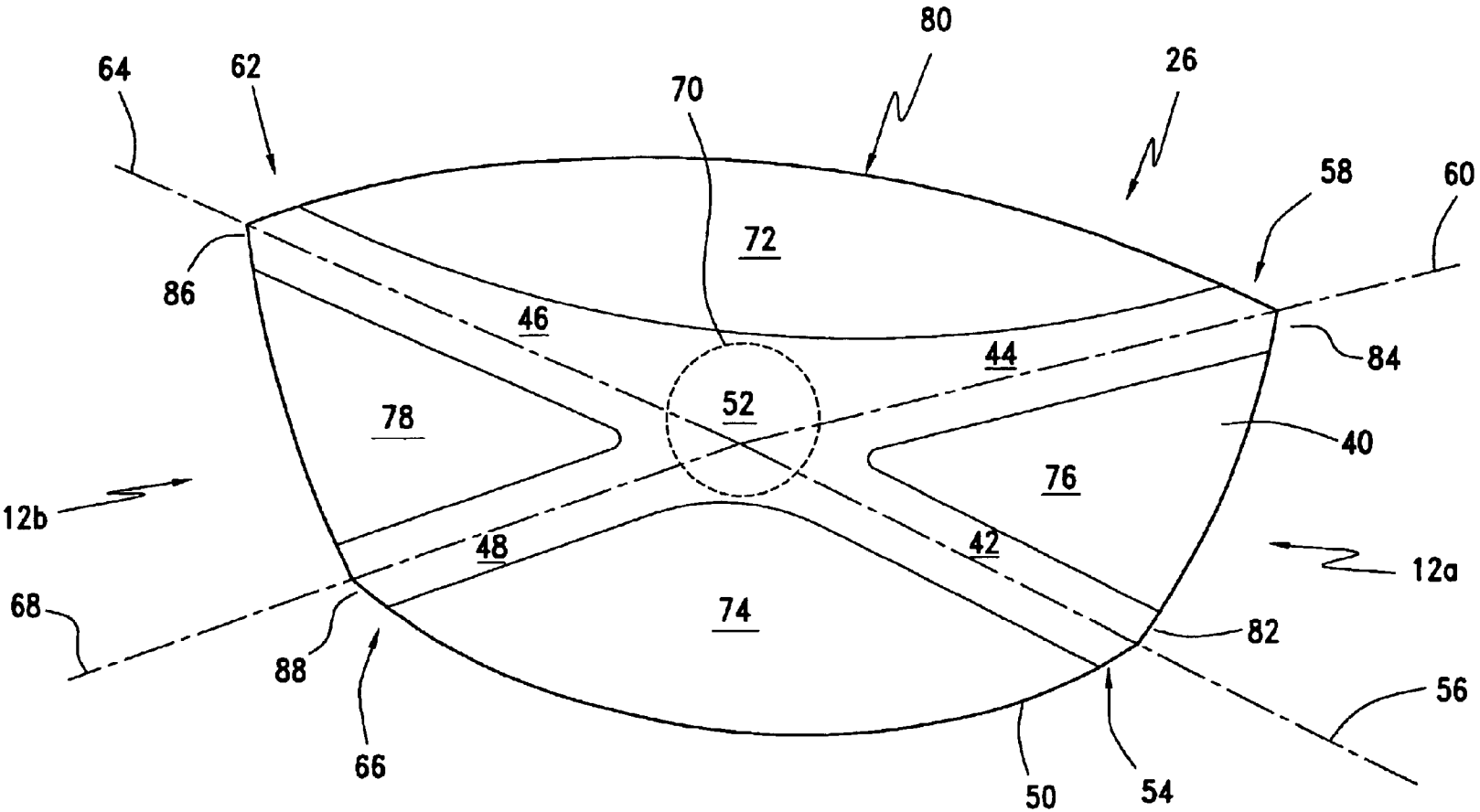
FIG. 3 is a plan view of the back surface of the face of the golf club of FIG. 1 generally showing the outline of the diagonal stiffening regions; and, FIG. 4 a plan view of the back surface of the face of an alternative embodiment of a golf club incorporating features of the present invention.

As shown in FIGS. 2 and 3, the back surface 40 of face 26 is contoured to provide a plurality of diagonal stiffening regions 42, 44, 46 and 48 that extend from the perimeter 50 of face 26 toward the central region 52 of face 26. Diagonal stiffening region 42 extends from the heel-sole quadrant 54 along axis 56 toward central region 52. Diagonal stiffening region 44 extends from heel-crown quadrant 58 along axis 60 toward central region 52. Diagonal stiffening region 46 extends from toe-crown quadrant 62 along axis 64 toward central region 52. Diagonal stiffening region 48 extends from toe-sole quadrant 66 along axis 68 toward central region 52. Central region 52 itself comprises a quasi-spherical bulging area 70 that tapers in thickness alone a vertical plane through central region 52 and alone a horizontal plane through central region 52. As seen most clearly in FIG. 2, the thickness alone the horizontal and vertical planes through central region 52 tapers more abruptly than the thickness along diagonal stiffening region 42, 44, 46 and 48.

As can be seen from FIGS. 2 and 3, the diagonal stiffening regions 42, 44, 46 and 48 blend smoothly into the back surface 40 of face 26 and divide the back surface 40 into four relatively thinner sections, namely crown section 72, sole section 74, heel section 76 and toe section 78. The diagonal stiffening regions 42, 44, 46 and 48 taper from a maximum thickness of 0.133 inch in central region 52 to approximately 0.110 inches outside of central region 52 to approximately 0.075 inches proximate the perimeter of 50 of face 26 along their respective axis 56, 60, 64 and 68. The relatively thinner crown section 72 and sole section 74 comprise broader regions ranging from 0.075 inch to 0.100 inch in thickness. Similarly, heel section 76 and toe section 78 comprise broad regions having a thickness of 0.073 to approximately 0.100 inches in thickness.

Figure 4:
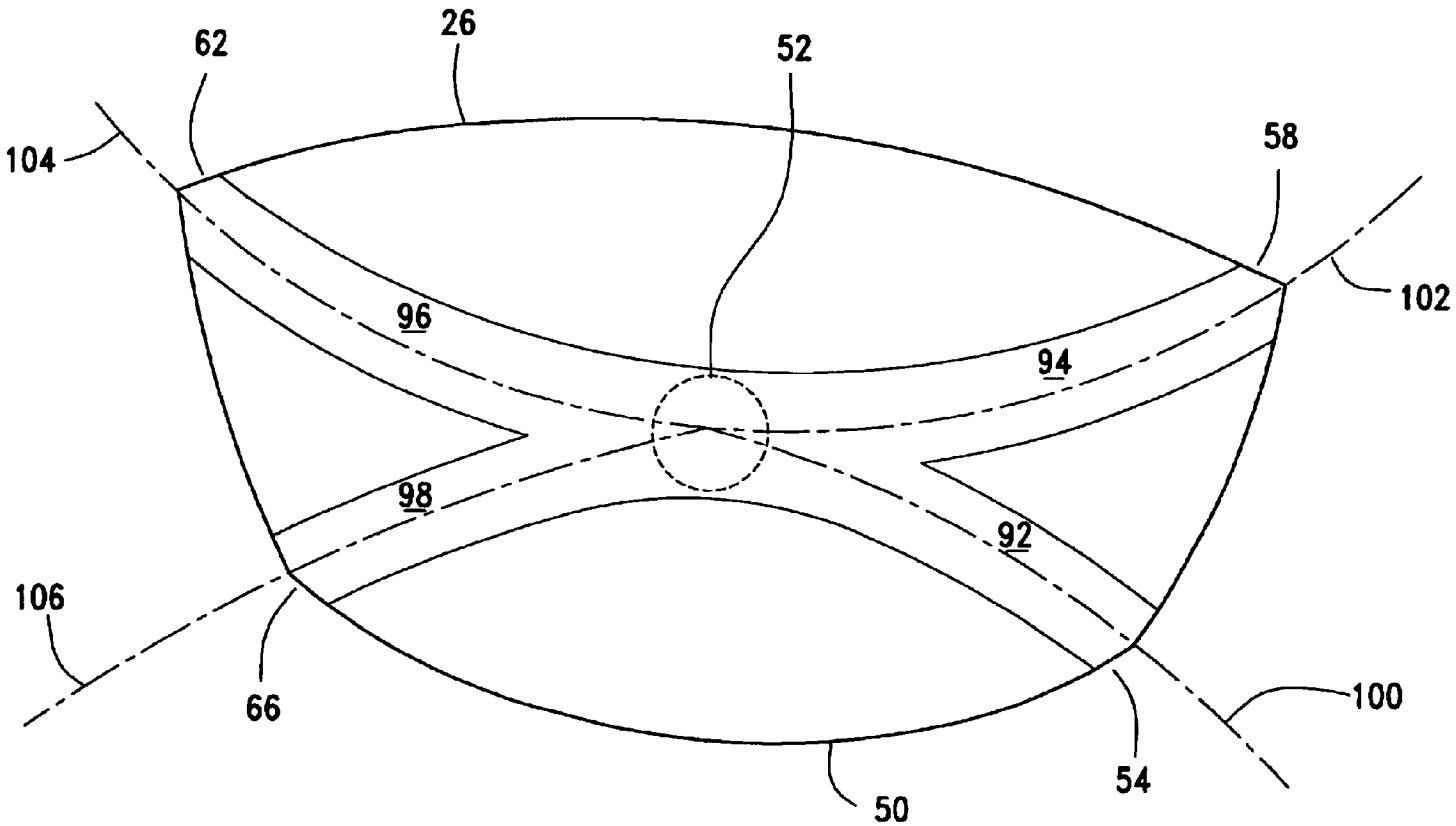

As shown in FIG. 4, the diagonal stiffening regions in accordance with the present invention need not be linear in an elevational view. As shown in FIG. 4 an alternative embodiment comprises diagonal stiffening regions 92, 94, 96 and 98 that extend from the perimeter 50 of face 26 toward the central region 52 of face 26. Diagonal stiffening region 92 extends from the heel-sole quadrant 54 along a curved axis 100 toward central region 52. Diagonal stiffening region 94 extends from heel-crown quadrant 58 along a curved axis 102 toward central region 52. Diagonal stiffening region 96 extends from toe-crown quadrant 62 along a curved axis 104 towards central region 52, and diagonal stiffening region 98 extends from toe-sole quadrant 66 along a curved axis 106 toward central region 52.

Since the primary stiffening of face 26 is accomplished with the diagonal stiffening regions 42, 44, 46 and 48 the intersection between crown section 72 and crown 20 of golf club 10 need not be reinforced to carry a substantial load. Similarly, the intersections at the remainder of perimeter 50 of face 26 need not be reinforced in the region of sole section 74, heel section 76 or toe section 78. This leads to substantial weight savings over prior art golf club faces which require substantial material to prevent cracking in these regions. Moreover, the diagonal stiffening regions 42, 44, 46 and 48 extend from the corners 82, 84, 86 and 88 at the heel-sole quadrant 54, heel-crown quadrant 58, toe-crown region 62 and toe-sole region 66, respectively. The high crown interfaces between the face 26 and the top wall 20, bottom wall 22 and side wall 24 at the corners 82, 84, 86 and 88 inherently have a higher area moment of inertia and, therefore, provide a stiffer anchor point for the diagonal stiffening regions than would be possible with vertical or horizontal stiffening regions that blend into the relatively straight, low crown interfaces along the top, bottom and side walls. Finally, because the stiffening regions extend diagonally across the quasi-rectangular golf club face 26, they are longer than a stiffening region extending horizontally or vertically across face 26. Accordingly, the moment arm acting on the stiffening regions when the club head impacts a ball are longer and therefor the club face can be made more flexible without exceeding the yield point or low cycle fatigue limit of the stiffening regions. This in turn leads to more efficient transfer of energy from the golf club head to the ball with correspondingly longer trajectories.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club head comprising:

a hollow body including a face composed of a forged metal material, said face comprising a ball striking surface and a back surface opposite the ball striking surface, said face comprising a heel edge, a toe edge, a sole edge and a crown edge;

a first diagonal stiffening region on said back surface extending along a first axis from a heel-sole quadrant to a central region of the face;

a second diagonal stiffening region on said back surface extending along a second axis from a heel-crown quadrant to said central region of the face;

a third diagonal stiffening region on said back surface extending along a third axis from a toe-crown quadrant to said central region of the face;

a fourth diagonal stiffening region on said back surface extending along a fourth axis from a toe-sole quadrant to said central region of the face; said first diagonal stiffening region having a thickness that tapers gradually from a first thickness proximal said first axis to a second thickness distal from said first axis, said second diagonal stiffening region having a thickness that tapers gradually from a third thickness proximal said second axis to a fourth thickness distal from said first axis, said third diagonal stiffening region having a thickness that tapers gradually from a fifth thickness proximal said third axis to a sixth thickness distal from said third axis, said fourth diagonal stiffening region having a thickness that tapers gradually from a seventh thickness proximal said second axis to an eighth thickness distal from said fourth axis; said first thickness being greater than said second thickness, said third thickness being greater than said fourth thickness, said fifth thickness being greater than said sixth thickness and said seventh thickness being greater than said eighth thickness; and a locally thickened central region having a thickness which tapers gradually along a vertical axis extending from said locally thickened central region toward said sole edge and said crown edge and which tapers along a horizontal axis extending from said locally thickened central region toward said heel edge and said toe edge, the thickness of said locally thickened central region tapering more abruptly than the thickness of said diagonal stiffening regions.

2. The golf club head of claim 1, wherein:

said first, third, fifth and seventh thicknesses are equal.

3. The golf club head of claim 1, wherein:

said first, second, third and fourth axes are straight.

4. The golf club head of claim 3 wherein:

said first and third axes are co-linear and said second and fourth axes are co-linear.

5. The golf club head of claim 1, wherein:

said first, second, third and fourth axes are curved.

6. The golf club head of claim 1, wherein:

said locally thickened region has a thickness greater than each of said first, third, fifth, and seventh thicknesses.

7. The golf club head of claim 1, wherein:

said forged metal material comprises forged titanium.

* * * * *